United States Patent [19]

Reier et al.

[11] 4,084,678

[45] Apr. 18, 1978

[54] PRINTER NEEDLE GUIDE MEANS FOR MOSAIC PRINTERS

[75] Inventors: Richard Reier, Taufkirchen; Peter Kuelzer, Munich, both of Germany

[73] Assignee: Siemens Aktiengesellschaft, Berlin & Munich, Germany

[21] Appl. No.: 687,292

[22] Filed: May 17, 1976

Related U.S. Application Data

[62] Division of Ser. No. 598,926, Jul. 25, 1975, Pat. No. 4,046,303.

[30] Foreign Application Priority Data

Jul. 31, 1974 Germany ..... 2436970

[51] Int. Cl.[2] ..... B41J 3/12

[52] U.S. Cl. ..... 197/1 R; 101/93.05

[58] Field of Search ..... 197/1 R; 101/93.04, 101/93.05; 308/1 R, 3 R, DIG. 8

[56] References Cited

U.S. PATENT DOCUMENTS

| | | | |
|---|---|---|---|
| 2,681,614 | 6/1954 | Rast | 197/1 R X |
| 3,627,096 | 12/1971 | Finnegan | 197/1 R |
| 3,900,094 | 8/1975 | Larsen et al. | 197/1 R |
| 3,927,751 | 12/1975 | Juvet | 197/1 R |
| 4,005,770 | 2/1977 | Hirose et al. | 197/1 R |

FOREIGN PATENT DOCUMENTS

| | | | |
|---|---|---|---|
| 2,407,830 | 9/1974 | Germany | 197/1 R |
| 2,309,071 | 9/1973 | Germany | 197/1 R |
| 2,057,961 | 6/1971 | Germany | 197/1 R |

*Primary Examiner*—Paul T. Sewell

*Attorney, Agent, or Firm*—Hill, Gross, Simpson, Van Santen, Steadman, Chiara & Simpson

[57] ABSTRACT

Mosaic printer needle guide structure comprising at least a pair of grooved guide members assembled together and having cooperating complementary confronting grooves providing guides for the printer needles. The guides are made by stamping or embossing rolled or drawn sheet metal.

13 Claims, 4 Drawing Figures

PRINTER NEEDLE GUIDE MEANS FOR MOSAIC PRINTERS

This is a division of application Ser. No. 598,926 filed July 25, 1975 now U.S. Pat. No. 4,046,303.

This invention relates to the printing art, and is more particularly concerned with new and improved guide means for mosaic printer needles.

A major drawback encountered in the utilization of mosaic printers for recording information is the generally inferior print quality obtained in comparison with type printers. This is due on one hand to the fact that in accordance with mosaic printing principles characters are made up of individual punctiform print elements, and on the other hand due to the fact that the individual imprints are not printed with precision in the prescribed pattern. One reason for deviation of the printed result from the prescribed print pattern may be found in the inaccuracy of guidance of the printer needles adjacent to the printing area. Quite apart from manufacturing inaccuracy which, if sufficient time and expense are devoted to the problem during manufacture can be tolerably small, wear in the needle guiding surfaces leads to inaccuracies in guidance of the needles during printing.

Numerous measures have been proposed in attempts to reduce or alleviate the effects of wear in the printer needle guides. One such proposed device is found in printed German application No. 2,057,961 and is characterized in that the printer needles are held in contact with a fixed jaw component attached to a frame adjacent to the printing location, being so held by a mobile jaw component which is biased into contact with the printer needles by constantly operative elastic thrust elements. With this arrangement, the fact has been neglected that the printer needles are operated with different frequencies in printer operation, so that the wear differs as well. The ratio of frequency of actuation of the printer needles which are most frequently used, and those which are less often used is around 1 : 2. Thus, because the guide cannot sufficiently compensate for the more frequently operated printer needles, those which are less frequently used are correspondingly more highly loaded by the constantly operating elastic thrust elements or biasing means.

Another known device (German published application No. 1,817,850) is characterized by a jewel inserted in the needle guide head containing guide holes for the forward ends of the printer needles. This arrangement, on the one hand is expensive from the manufacturing point of view, and on the other hand leads to increased wear in the printer needles. This drawback can, it is true, be reduced by the use of printer needles materials having high wear resistance, but it cannot be completely overcome.

A principal object of the present invention is to provide a device for guiding the printer needles adjacent to the printing area, and which device is capable of being manufactured with the requisite accuracy at reasonable cost and which is itself substantially free from wear and is substantially free from causing any wear in the printer needles.

According to features of the invention, there is provided a printer needle guide device for use in the printer heads of mosaic printers adjacent to the printing location and utilizing at least a pair of grooved guide component members provided with complementary cooperating confronting grooves providing guides for the individual printer needles and adapted to be economically manufactured from rolled or drawn sheet metal by a die stamping or embossing operation without any metal cutting being involved in formation of the grooves.

Guides manufactured in accordance with these inventive features, have a number of advantages compared with known kinds of guides. The rolled or drawn materials have a hardened surface which is not only unaffected by the stamping or embossing operation but is in fact made even tougher. Also, the avoidance of a cutting machining process means that no additional surface roughness is created, and which roughness would on the one hand have a wearing effect upon the printer needle and on the other hand would be worn down after lengthy service so that the printer needles would acquire an undesirably high degree of play in their guides. Avoidance of roughness of the guide surfaces, in accordance with the present invention can be readily controlled by the quality of the basic material and by the working tools.

Parallelism of the stamped or embossed profiles of the tool used to produce the guide grooves in the guide component elements can be achieved to the requisite degree of accuracy without particularly high expenditure. Because the guide component elements produced by the stamping or embossing forming operation can be assembled together by placing them face-to-face, any pitch inaccuracies in the pitch intervals between the guide grooves, these being difficult to control, do not have any undesirable influence upon the guidance properties. Once the guide components have been centered in relation to one another by the use of guide pins, they can simply be bonded or welded together. The guide pins used for this purpose have a diameter which is greater than that of the actual printer needles which are to be guided, by the amount of the desired guide clearance.

In accordance with a preferred embodiment, a device in accordance with the invention comprises guide component members made of sheet metal stamped or embossed to provide a corrugated guide surface. By the use of relatively thin sheet metal plates as a basic material, manufacturing economy is achieved, and it is possible to provide a plurality of rows of needle guides which are staggered in relation to one another.

According to another preferred embodiment of the device according to the present invention, the guide component members may have openings therethrough intersecting the guide grooves, whereby double guidance of the printer needles is achieved not only closely adjacent to the printing location, but also at a predetermined distance therefrom. Because both of the guide sections thus provided constitute part of the same guide component members, no relative adjusting operations are required during assembly in order to bring the cooperating guide sections into alignment with each other. Dual guidance of the printer needles is advantageous because for reasons associated with the space occupied by the electromagnetic systems which actuate the printer needles, the needles are guided toward the printing area in a curvilinear fashion, although adjacent to the printing location itself, the needles must be guided in as nearly parallel fashion as possible. Therefore, long, uninterrupted guides for the printer needles in this zone would give rise to additional guidance problems.

Advantageously, material used for the guide components may comprise steel having qualities permitting hardening or to receive a hard surface finish.

Other objects, features and advantages of the invention will be readily apparent from the following description of certain representative embodiments thereof, taken in conjunction with the accompanying drawing although variations and modifications may be effected without departing from the psirit and scope of the novel concepts embodied in the disclosure, and in which.

Figure 1:
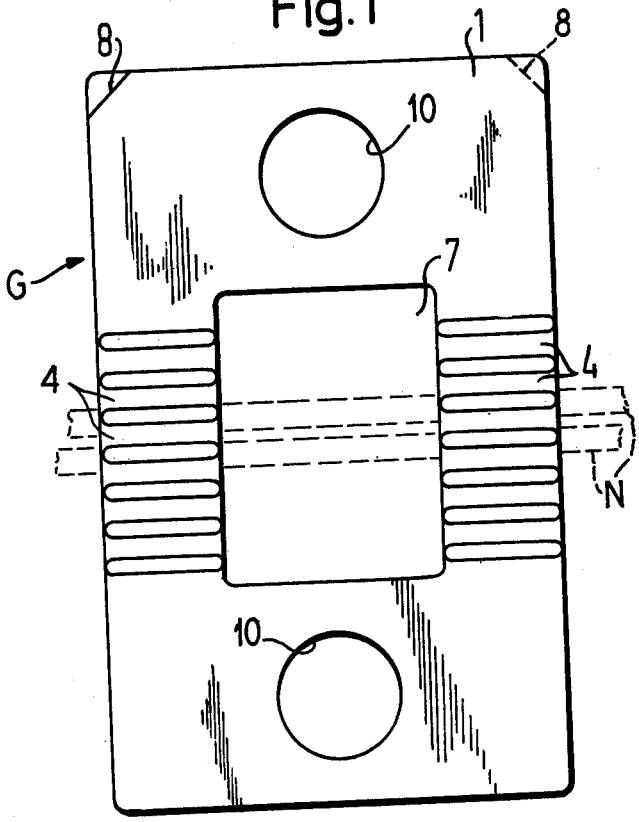
FIG. 1 is a side elevational view of a representative form of guide comprising three component members stacked and attached together providing two rows of guides for the printer needles.
Figure 2:
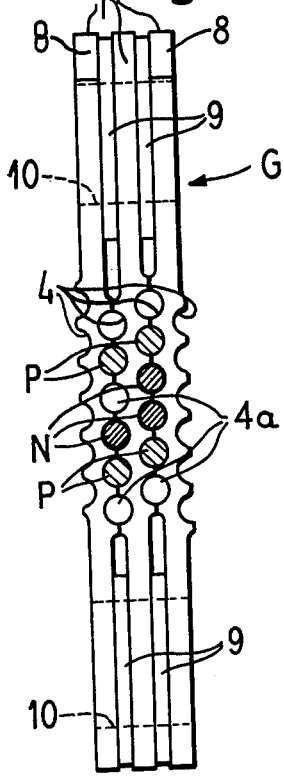
FIG. 2 is a top plan view of the guide assembly of FIG. 1.
Figure 3:
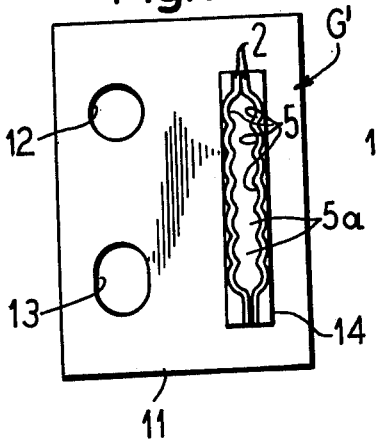
FIG. 3 is a plan view of a modified guide assembly providing a single row of needle guides.
Figure 4:
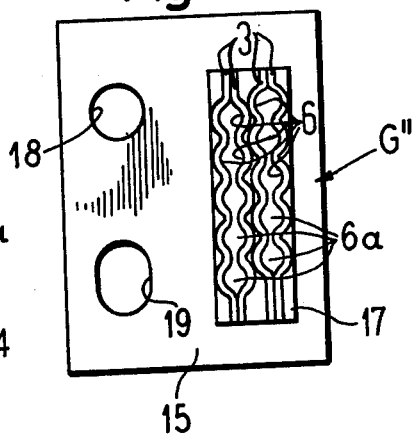
FIG. 4 is a plan view of another modified form of needle guide assembly providing a plurality of rows of needle guides.

All of the devices shown in the drawing comprise guides for printer needles in mosaic printer heads. In FIGS. 1 and 2 a guide assembly unit G comprises a plurality, in this instance three, suitable gauge sheet metal plate panel components 1 having grooves 4 providing guideways 4*a*. In FIG. 3 a guide assembly unit G′ comprises sheet metal plate panel components 2 having grooves 5 providing guideways 5*a*, in this instance comprising a pair of such component members. In FIG. 4 a guide assembly unit G″ comprises sheet metal guide component panel members 3 assembled in two pairs so that grooves 6 therein provide guideways 6*a*.

Having reference to FIGS. 1 and 2, each of the component plate members 1 is preferably of elongated generally rectangular shape and formed from suitable gauge sheet metal such as steel which can be readily stamped or embossed and can be fully hardened or surface or case hardened. Formed transversely across a central area of the narrow dimension of each of the plates or panels 1 is a plurality of parallel equal, generally semicircular guide grooves 4 shaped by stamping or embossing the panel by means of suitable punch and die equipment. In a preferred construction, the grooved area is located intermediate opposite substantially flat end portions of each of the plates or panels and is uniformly corrugated to form a set of the grooves 4 on each side of each of the panels 1 in a staggered relation as best seen in FIG. 2 and running out at opposite edges of the panel along the grooved area and extending between said opposite end portions. Thereby, any two of the panels 1 can be assembled in generally face-to-face relation with the complementary grooves 4 cooperating in confronting relation to provide the substantially cylindrical needle guideways 4*a*. In order to interrupt the guideways 4*a* and divide them into two aligned sections, each of the panels 1 has an opening 7 extending entirely across the group of guide grooves 4.

In order to facilitate stacking the panels 1 with the grooves 4 properly related to provide the cylindrical needle guideways 4*a*, each of the plates is provided with indexing means, in a desirable form comprising a common corner area 8 clipped off or cut back on a diagonal line. Thus, in a three-panel assembly as shown, by orienting the clipped indexing corners 8 alternately so that the intervening panel 1 has its indexing corner 8 at the opposite side from the indexing corners 8 of the other two panels and the flat end portions of the panels aligned, the staggered grooves 4 of the panels will be in proper orientation to provide two complete rows of the guiding bores or bearing guideways 4*a*.

In order to assure precision in alignment of the confronting grooves 4 in the assembled relation of the panels 1, suitable indexing means are employed, in one desirable form comprising combination indexing and gauging pins P (FIG. 2) which are slightly larger diameter than printing needles N so that in the completed guide assembly G proper sliding clearance will be provided for the printing needles in the guideways 4*a*. Thus by placing two or more of the indexing and gauging pins P between confronting grooves 4 in each row of guideways 4*a* in the assembly, and securing the panels 1 fixedly together as thus indexed and gauged, accurate orientation and sizing of the guideways 4*a* will be achieved. Suitable bonding or welding means 9 between the flat opposite end portions of the panels 1 secures them fixedly together in the indexed and gauged assembly, thus, completing the guide unit G. The means 9 may also serve as spacers between the substantially flat end portions of the plates 7 cooperative with the undulations of the corrugations providing the grooves 4 to maintain the size of the pin guideways accurately dimensioned for free sliding guiding of the printing needles N.

In order to facilitate mounting the guide unit G in a mosaic printer head, indexing or bolt holes 10 are formed through the opposite end portions of the unit.

In one desirable form, the guide member panels 1 are made from work-hardenable steel so that in die pressing or embossing the grooves 4 in the panels the material in the panels defining the grooves 4 is adequately work-hardened to provide adequately wear resisting bearing surfaces for the guideways 4*a*. In addition, or alternatively, the panels 1 may be surface or case hardened at least in the grooved areas thereof to assure hard, wear resistant bearing surfaces within the grooves 4.

On referring to FIG. 3, it may be observed that the guide assembly unit G′ is of a somewhat different format in that the panel components 2 have the guide grooves 5 shallow and only on one face of the panel and with the grooved area of each of the panels 2 offset relative to opposite end portions which end portions are suitably secured together as by being bonded or welded, similarly as described in connection with the guide unit G, or otherwise. The grooves 5 are oriented in confronting relation so that they provide the accurate guideways 5*a* for the printing needles. Support for the unit G′ is provided by a printing head member 11 having suitable apertures 12 and 13 to facilitate securing it in the desired position in the printer adjacent to the printing area. The guide G′ is carried by the member 11 within a recess 14.

Construction of the guide unit G″ of FIG. 4 is similar to but somewhat different from the guide unit G′ in that the grooves 6 formed by stamping or embossing the panels 3 are not as shallow as the grooves 5. The grooved areas of the panels 3 are offset relative to the opposite end portions thereof and the opposite end portions are secured together in any suitable fashion as by bonding or welding, with the grooves 6 confronting one another in the complementary pairs of the panels 3 to provide the two rows of guideways 6*a*. A printing head member 15 has a recess 17 within which the dual guideway row guide assembly G″ is supported. Means comprising indexing or bolt holes 18 and 19 are provided in the member 15 to facilitate mounting it in a mosaic printer adjacent to the printing area in which the printing needles to be guided by the guideways 6a are to operate.

Similarly as described in connection with the unit G of FIGS. 1 and 2, the panels 2 of FIG. 3 and the panels 3 of FIG. 4 are desirably formed from steel that can be readily worked by stamping or embossing the guideway grooves in the panels, the material being work-hardenable or at least surface or case hardenable to provide adequately wear-free bearing surfaces in the needle guideways.

In all forms of the invention the grooved needle guideway plates are provided with the guideway grooves by die stamping or embossing without any cutting shaping, i.e. machining, being involved, thereby avoiding the disadvantages of machined surfaces, as explained hereinbefore.

It will be understood that variations and modifications may be effected without departing from the spirit and scope of the novel concepts of this invention.

We claim as our invention:

1. A guide device for the printer needles used in the printer heads of mosaic printers to guide the needles adjacent to the printing area of the associated printer, and comprising:

at least a pair of relatively thin stamped sheet metal guide member plates having opposite substantially flat end portions and an intermediate area between the end portions defined by opposite plate edges which extend from side to side between said end portions, the guide member plates being assembled together in face-to-face relation with said end portions aligned and secured together;

and each of said intermediate areas of the guide member plates having an array of corrugations which extend between said edges and undulate to opposite sides of the original face planes of the plates;

said corrugations comprising at least on the face-to-face faces of said areas grooves providing guideways for the printer needles;

said grooves being substantially accurately stamped or embossed in the corrugations and free from any cutting shaping so that the groove surfaces are inherently smooth and free from roughness.

2. A guide device according to claim 1, wherein said corrugated areas of the plates are offset relative to said end portions of the plates and with the face-to-face faces of the corrugated areas spaced apart and with the corrugations of the faces aligned to provide the guideways for the printer needles, the end portions of the pair of plates being in face-to-face abutting relation.

3. A guide device according to claim 1, wherein the undulations of each of the plates project beyond the face plane of each of the faces of each of the substantially flat end portions, and the aligned end portions of the pair of plates are spaced apart sufficiently to accommodate the corrugation undulations and to provide for accurate dimensioning of the guideways formed by the grooves to receive the printer needles in close sliding guided relation.

4. A device according to claim 1, wherein the guide member plates have openings in a central part of said area and interrupting the guide grooves.

5. A device according to claim 4, wherein said guide member plates are made from work hardenable steel.

6. A device according to claim 1, wherein said guide member plates are made from hardenable steel material.

7. A device according to claim 1, comprising three of said guide member plates having said grooves, providing two rows of the guideways in staggered relation.

8. A device according to claim 1, comprising four of said guide member plates assembled together and providing two adjacent rows of said guideways.

9. A device according to claim 1, guide member plates means securing said flat end portions fixedly together with said guideways sized to permit free sliding movement of printer needles therein.

10. A device according to claim 1, including means for supporting the device in a printer head.

11. A device according to claim 1, wherein the surfaces of said grooves of said guide member plates are work hardened by virtue of being stamped or embossed, whereby to provide the wear resistant groove surfaces for the guideways.

12. A device according to claim 1, wherein said guide member plates are substantially rectangular in outline and have corners thereof clipped off on diagonal lines to facilitate proper orientation of the guide member plates in assembling them to match the grooves to provide said guideways.

13. A device according to claim 1, wherein said corrugated array of grooves comprise grooves in staggered relation on both of the opposite faces of each of the guide member plates.

* * * * *